US005489060A

United States Patent [19]

Godard

[11] Patent Number: 5,489,060

[45] Date of Patent: Feb. 6, 1996

[54] RECLOSABLE PACKET

[75] Inventor: Pascal C. Godard, Villemomble, France

[73] Assignee: Kraft General Foods France, France

[21] Appl. No.: 124,420

[22] Filed: Sep. 14, 1993

[51] Int. Cl.[6] ..... B65D 65/28; B65D 65/34

[52] U.S. Cl. ..... 229/87.05; 229/87.07; 229/125.37; 229/238

[58] Field of Search ..... 229/87.05, 87.07, 229/125.37, 225, 238

[56] References Cited

U.S. PATENT DOCUMENTS

| | | | |
|---|---|---|---|
| 1,132,781 | 3/1915 | Lile . | |
| 1,329,056 | 1/1920 | Mester . | |
| 2,008,361 | 7/1935 | Lindsey | 229/87.07 |
| 2,079,328 | 5/1937 | McBean | 229/87.05 |
| 2,307,667 | 1/1943 | Cornock | 229/87.05 |
| 2,789,752 | 4/1957 | Will | 229/87.05 |
| 2,822,118 | 2/1958 | Will | 229/17 |
| 3,362,617 | 1/1968 | Gieber | 229/87.05 |
| 3,403,840 | 10/1968 | Mathes | 229/87.05 |
| 4,289,240 | 9/1981 | Mueller | 206/624 |
| 4,982,845 | 1/1991 | Prascak et al. | 229/87.05 |
| 4,986,420 | 1/1991 | Gunn et al. | 229/≅ |
| 5,129,513 | 7/1992 | David et al. | 206/265 |

FOREIGN PATENT DOCUMENTS

| | | | |
|---|---|---|---|
| 2840409 | 4/1980 | Germany | 229/87.05 |

*Primary Examiner*—Gary E. Elkins
*Attorney, Agent, or Firm*—Joyce P. Hill; Thomas R. Savoie

[57] ABSTRACT

A reclosable chewing gum packet, and a blank for making that packet. The packet includes a multitude of side panels and a tear strip attached to and transversely extending across each of those side panels. The tear strip is cut through, adjacent a first end thereof, to separate the tear strip into first and second sections. The first section of the tear strip is torn away from the packet to form a lateral tear line, separating the packet into a cover and a body. When this is done, the transverse cut through the tear strip prevents the first section of the tear strip from tearing the second section of the tear strip away from the packet. That second section of the tear strip remains attached to the packet and forms a flexible hinge connecting the cover of the packet to the body thereof.

11 Claims, 1 Drawing Sheet

RECLOSABLE PACKET

BACKGROUND OF THE INVENTION

The present invention generally relates to reclosable cartons or packets and to blanks for making such cartons or packets; and, more specifically, this invention relates to such cartons or packets that are well-suited for holding sticks of chewing gum.

Conventionally, a chewing gum packet is opened by pulling a narrow tear strip that extends around a top portion of the packet to separate that top portion from the rest of the packet. That top portion is then removed, providing access to the individual chewing gum sticks in the packet.

There are several disadvantages of this conventional prior art procedure. First, after the top portion of the packet is removed, the chewing gum sticks may slide out of the packet and scatter in, for instance, the pocket or purse of the person carrying the packet. Second, after the chewing gum packet has been opened, the chewing gum sticks inside the packet may loose water vapor and other molecular ingredients, so that the chewing gum sticks, over time, may become dry and breakable and loose their flavor and aroma.

Prior art chewing gum packets are disclosed, for example, in U.S. Pat. Nos. 2,118,849, 1,329,056, and 1,132,781. U.S. Pat. Nos. 2,118,849 and 1,329,056 disclose chewing gum packets having top covers that are separated from the bodies of the packages either by removing a tear strip or by tearing along a perforated line. U.S. Pat. No. 1,132,781 discloses a chewing gum package having a top flap that can be selectively opened and closed. This top flap, however, is formed by a separate strip of material that is pre-folded and then inserted into the gum package.

SUMMARY OF THE INVENTION

This invention relates to a packet having a reclosable top cover. More specifically, the packet includes a multitude of side panels connected together to form a packet, and the side panels include top portions folded together to form a top for the packet and bottom portions folded together to form a bottom for the packet. The packet also includes a tear strip attached to and transversely extending across each of said multitude of side panels, adjacent the top of the packet, to form a lateral tear line around the packet and thereby to separate the packet into a cover and a main body.

This tear strip is itself transversely cut through, adjacent a first end thereof, to separate that tear strip into first and second sections. When the first section of the tear strip is torn away from the packet to form the above-mentioned tear line, this transverse cut through the tear strip prevents the first section of the tear strip from tearing the second section of the tear strip away from the packet. That second section of the tear strip remains attached on the packet and forms a flexible hinge connecting the cover of the packet to the main body thereof.

The cover of the packet may be pivoted about this hinge, between open and closed positions; and preferably the packet includes an adhesive strip, attached to either the cover or the main body of the packet, to hold the cover releasably in the closed position. In addition, preferably the tear strip lies over and is attached to a gripping tongue that projects beyond a side of the packet to help a person grip that tear strip.

A blank for making this packet may be formed in a continuous, automated process. In this process, a given length of a flexible packaging material is unwound from a supply thereof, a multitude of fold lines are formed transversely across that length of material to separate that material into a multitude of contiguous panels, and a tear strip is attached to that length of material, adjacent and parallel to a longitudinally extending edge thereof. That length of material is separated from the supply of packaging material, and a transverse cut is made through the tear strip to separate that strip into first and second sections.

The packet is made from this blank by folding the blank about the fold lines and connecting the panels to form a four sided enclosure. Top portions of the panels are folded inward and together to form a top of the packet, and bottom portions of the panels are folded inward and together to form a bottom of the packet.

Benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
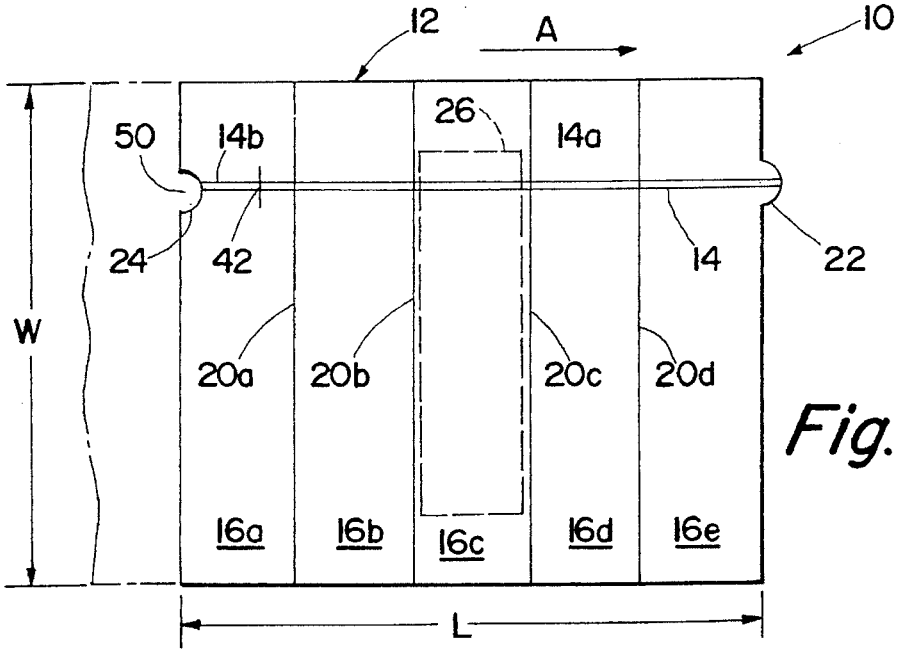
FIG. 1 is a plan view of a blank for making a reclosable packet in accordance with the present invention.

FIG. 1 illustrates blank 10 comprising a base 12 and a tear strip 14; and base 12, in turn, includes a multitude of side panels **16*a*–16*e* and a multitude of fold lines 20*a*–20*d*. Preferably, blank 10 also includes a gripping tongue 22 and notch 24. The embodiment of blank 10 shown in FIG. 1 has a generally rectangular shape, with a length L and width W, and the blank has generally parallel longitudinal edges and a pair of end or transverse edges. Fold lines 20*a*–20*d* transversely extend completely across the width of blank 10 and are equally spaced apart along the length of the blank, separating the blank into the side panels 16*a*–16*e***.

Blank 10 is designed to make packets or cartons that are used to hold a multitude of sticks of gum, one of which is shown in outline at 26 in FIG. 1. Preferably, the width of each panel **16*a*–16*e* of blank 10 is slightly greater than the widths of those sticks of gum, and the length of each panel is longer than the lengths of those sticks of gum. In fact, preferably, panels 16*a*–16*e*** are sufficiently long to allow the tops and bottoms of the panels to be folded over and under, respectively, the sticks of gum inside the packet to form tops and bottoms of that packet.

Blank 10 may be made of any suitable material, and fold lines **20*a*–20*d* may be made in any suitable manner. Preferably, side panels 16*a*–16*e* are integrally connected together; and, for example, blank 10 may be made of a flexible packing material such as paper, and one face or side of the blank may be plasticized. Alternatively, blank 10** may be made of a thermoplastic film.

Figure 2:
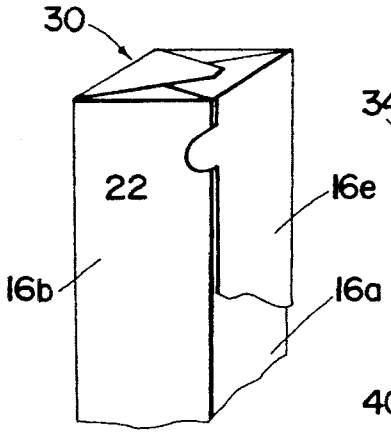
FIG. 2 is a perspective view of a portion of a packet made from the blank of a FIG. 1.
Figure 3:
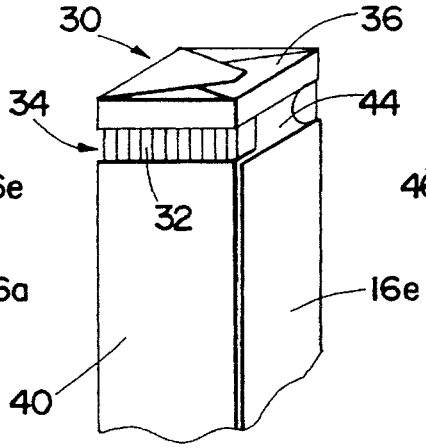
FIG. 3 shows the packet of FIG. 2 after a tear strip has been removed to form a reclosable top closure for the packet.
Figure 4:
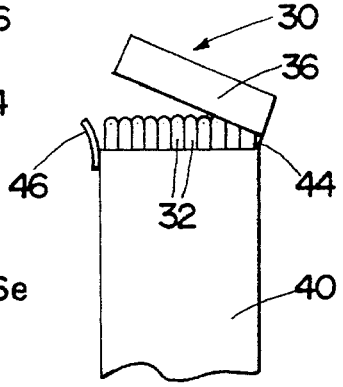
FIG. 4 is a side view of the packet, with the top closure shown in an open position.

Blank 10 is used to make a packet shown at 30 in FIGS. 2–4. More specifically, packet 30 is made by folding side panels **16*a*–16*e* of blank 10 about fold lines 20*a*–20*d* to form a four sided enclosure, and with panel 16e located outside of and directly against panel 16*a*. Top portions of panels 16*a*–16*e* are folded inward and together to form a top of the packet, and bottom portions of panels are folded inward and together to form a bottom of the packet. Gum sticks 32 may be positioned on blank 10 prior to or during the folding of panels 16*a*–16*e*, so that packet 30 is formed or wrapped around those gum sticks, or the gum sticks may be positioned in the packet after side panels 16*a*–16*e*** are folded and connected together.

With reference again to FIG. 1, tear strip 14 is attached to and longitudinally extends completely across each of side panels **16*a*–16*e* of blank 10, adjacent the top portions of those side panels; and the tear strip is provided to form a lateral tear line, shown at 34 in FIGS. 3 and 4, around the packet 30 formed from blank 10, thereby to separate that packet into a cover 36 and a main body 40. Also, tear strip 14 is itself transversely cut through, at 42, adjacent a first end of the tear strip to separate the tear strip into first and second sections 14*a* and 14*b*. In this way, when the first section 14*a* of the tear strip is torn away from packet 30 to form tear line 34, cut 42 prevents that first section 14*a* from tearing second section 14*b* away from packet 30; and second section 14*b* is left on the packet 30 and forms, with the attached portions of side panel 16*e*, a flexible hinge 44 connecting cover 36 of the packet to main body 40** thereof.

Tear strip 14 may be made of any suitable material and attached to blank base 12 in any suitable manner. For example, tear strip 14 may be glued to the blank base 12 by a conventional adhesive, and the tear strip is made of a material that is stronger than the material of base 12, so that as the strip 14 is torn away from packet 30, the material of base 12 tears away with the tear strip.

Preferably, tear strip 14 is completely cut through at 42, both laterally and through the depth of the tear strip. As will be understood by those of ordinary skill in the art, it is not necessary that tear strip 14 be completely cut through in this way. The important objective is that the cut 42 be such that the tear strip will break at the cut when the tear strip section **14*a* is pulled away from packet 30, and section 14*a* does not pull section 14*b* away from the packet. This objective may be achieved in other specific ways and, for example, tear strip 14 may be only partially cut through at 42** to provide the tear strip with the desired weakness at that point.

Gripping tongue 22 is provided to help a person grip an end of tear strip 14 to start the abovementioned tearing of that strip. More specifically, gripping tongue 22 is connected to and extends outward from a transverse edge of blank 10, and when packet 30 is formed from the blank, the gripping tongue projects outward of side panel **16*b*. At the same time, tear strip 14 lies over and is attached to the gripping tongue 22; and, in this way, a person may grip the end of tear strip 14 by gripping tongue 22. Preferably, gripping tongue 22 is integrally connected to side panel 16*a* and, as discussed below, tongue 22 and side panels 16*a*–16*e*** are made from a single unitary piece of material.

The use of tear strip 14 in the above-discussed manner enables packet cover 36 to be pivoted about hinge 44 between an open position (shown in FIG. 3) and a closed position (shown in FIG. 4). In the open position, cover 36 extends forwardly upwardly from hinge 44 and the front portion of the cover is spaced from the chewing gum sticks 32 in packet 30, providing access to those sticks. In the closed position, cover 36 extends closely over the tops of gum sticks 32, from hinge 44 to front panel **16*c*, holding those sticks in packet 30** and helping to prevent the loss of moisture and other molecular ingredients from those sticks to the ambient atmosphere.

Preferably, an adhesive strip 46 is provided to hold cover 36 releasably in the closed position. With the embodiment of packet 30 shown in the drawings, adhesive strip 46 is securely attached to packet body 40 and can be attached and detached at will from cover 36 when the cover is in the closed position, thereby to releasably hold the cover in its closed position. For example, the strip 46 may be permanently glued to panel **16*c* of body 40, and the top portion of the adhesive strip may be covered with a non-permanently bonding adhesive. When cover 36 is in the closed position, a person may attach the front edge of the cover to the top of strip 46 to hold the cover in the closed position. When that person wants to open the packet 30, the cover 36 is detached from strip 46** and then pivoted into the open position.

As may be understood, it is not necessary to the practice of this invention that strip 46 be permanently bonded to body 40 and releasably attached to cover 36, and this relationship may be reversed. In particular, strip 46 may be permanently bonded to cover 36, and the lower portion of the strip can be covered with a non-permanently bonding adhesive so that the strip can be attached and detached at will from packet body 40 to releasably hold the packet cover in its closed position.

Preferably, blank 10 is made in a continuous, automated process, during which a multitude of such blanks are continuously made in succession. For example, a multitude of blank bases 12 may be continuously unwound, one after another, in the direction of the arrow A of FIG. 1, from a band or roll of suitable packaging material. At the same time, tear strip 14 may be continuously unwound from a feeding bob, or other suitable means, and extended across and attached to these blank bases 12. At each length L of the unrolled packaging material, that material is transversely cut to form the back edge and the notch 24 of one blank, and the front edge and tongue 22 of the next succeeding blank base.

Preferably, this edge cut is made by, first, making a linear cut across the entire width of each blank, except for the zone 50 containing the tear strip 14, and then cutting across that zone 50 to form the complementary shaped tongue 22 and notch 24 of the adjacent blanks. The first of the above-mentioned cuts may be made, for example, by a rectilinear blade (not shown) provided with a notch so that this blade does not cut through zone 50; and after this operation, the blank is still connected to the band of packaging material by the narrow uncut zone 50.

Figure 5:
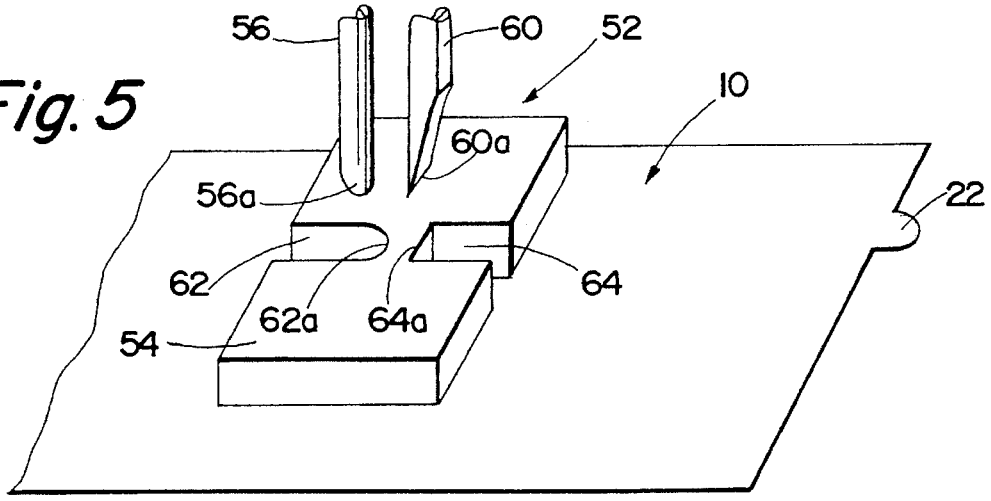
FIG. 5 shows a cutting device for making various cuts in the blank of FIG. 1.

The second of the above-mentioned cuts may be made by punch assembly 52 shown in FIG. 5. Preferably, this assembly is used to make the second of the above-mentioned cuts, and simultaneously to make cut 42 in tear strip 14. Generally, assembly 52 includes guide block 54 and punches 56 and 60. In use, punches 56 and 60 are disposed above blank 10 and are supported for upward and downward reciprocating movement to cut out tongue 22 and to form cut 42 in tear strip 14, and guide block 54 is positioned on blank 10 to guide that reciprocating movement of the punches 56 and 60. With the embodiment of assembly 52 shown in FIG. 5, guide block 54 forms two recesses 62 and 64 that are used to guide movement of punches 56 and 60, respectively, and the inward ends of these recesses **62*a* and 64*a* are spaced apart a distance equal to the desired distance between notch 24 and cut 42. Punches 56 and 60 are disposed above and are aligned with recesses 62 and 64 respectively; and punch 56 has a curved or arcuate bottom cutting edge 56***a* that matches the shape of gripping tongue 22, and punch 60 has a straight cutting edge 60*a*.

To make the cut 42 in one blank and to form the gripping tongue 22 of the next blank, guide block 54 is positioned on those two blanks, with the inward end of recess 64 positioned over the location at which it is desired to make the gripping tongue 22, and with inward end of recess positioned 62 over the location at which it is desired to make cut 40. Then, punches 56 and 60 are forced downward, through recesses 62 and 64 to form the gripping tongue 22 in region 50 and to form cut 42 through tear strip 14. With the preferred embodiment described above, tear strip 14 is cut at 40 after that strip has been attached to blank base 12. Alternatively, the tear strip may be cut prior to being attached to the blank base 12.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A reclosable packet comprising:

a multitude of side panels connected together to form a packet, the side panels including top portions folded, together to form a top for the packet, and bottom portions folded together to form a bottom for the packet;

a tear strip attacked to and transversely extending across each of said side panels adjacent the top of the packet, to form a lateral tear line around the pocket to separate the packet into body and a cover;

the tear strip having first and second opposite longitudinal ends;

the tear strip being transversely cut through, adjacent the first end thereof, to separate the tear strip into first and second sections, wherein when the first section of the tear strip is torn away from the packet to form said tear line, said transverse cut prevents the first section of the tear strip from tearing the second section thereof away from the packet, and said second section forms a flexible hinge connecting the cover of the packet to the body thereof; wherein said multitude of panels are arranged in sequence and include a first side panel and a last side panel in said sequence; and wherein said first and last side panels are connected together to form the packet, a first portion of the tear strip extends across and is bounded by the first side panel, and the transverse cut through the tear strip is formed through said first portion of the tear strip.

2. A reclosable packet according to claim 1, wherein the cover is moveable between open and closed positions, and further including an adhesive strip attached to one of the cover and the body, for releasably attaching to the other of the cover and the body to hold the cover releasably in the closed position.

3. A reclosable packet according to claim 2, wherein the multitude of side panels form a first transverse edge, and further including a gripping tongue connected to and longitudinally extending outward from said first edge, and wherein the tear strip is attached to and extends at least partially across the gripping tongue.

4. A reclosable packet according to claim 2, wherein:

the adhesive strip is permanently adhesively bonded to the body of the packet; and a top portion of the adhesive strip includes a non-permanently bonding adhesive to releasably attach the adhesive strip to the cover of the packet.

5. A reclosable packet according to claim 1, wherein:

said multitude of panels further includes a second side panel, a third side panel and a fourth side panel in said sequence; and said last side panel comprises a fifth side panel in said sequence.

6. A reclosable packet according to claim 1, wherein the tear strip has only one transverse through cut between the first and second ends of the tear strip.

7. A blank for making a reclosable packet, comprising:

a multitude of side panels connected together for forming the packet, the side panels including top portions to form a top for the packet, and bottom portions to form a bottom for the packet;

a tear strip attached to and transversely extending across each of the multitude of side panels, adjacent to the portions thereof, to form a lateral tear line around the packet and to separate the packet into a cover and a body;

the tear strip having first and second opposite longitudinal ends;

the tear strip being transversely cut through, adjacent the first end thereof, to separate the tear strip into first and second sections, wherein when the first section of the tear strip is torn away from tearing the second section thereof away from the packet, and the second section of the tear strip forms a flexible hinge, hingedly connecting the cover of the carton to the body thereof;

wherein said multitude of panels are arranged in sequence having first and second opposite ends and include a first side panel forming said first end of said sequence; and wherein a first portion of the tear strip extends across and is bounded by the first panel, and the transverse cut through the tear strip is formed through said first portion of the tear strip.

8. A blank according to claim 7, wherein the multitude of side panels form a first transverse edge, further including a gripping tongue connected to and longitudinally extending outward from said first transverse edge, and wherein the tear strip is attached to and extends at least partially across the gripping tongue.

9. A blank according to claim 7, further including an adhesive strip attached to one of the panels to releasably attach the cover of the packet to the body thereof.

10. A blank according to claim 7, wherein said multitude of panels further includes a second side panel, a third side panel, a fourth side panel and a fifth side panel in said sequence.

11. A blank according to claim 7, wherein the tear strip has only one transverse through cut between the first and second ends of the tear strip.

* * * * *